US012808552B2

(12) United States Patent
Jeong et al.

(10) Patent No.: US 12,808,552 B2
(45) Date of Patent: Nov. 24, 2026

(54) AIR CONDITIONER

(71) Applicant: LG Electronics Inc., Seoul (KR)

(72) Inventors: Changhoon Jeong, Seoul (KR); Jaeyong Ha, Seoul (KR); Sujung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 351 days.

(21) Appl. No.: 18/437,606

(22) Filed: Feb. 9, 2024

(65) Prior Publication Data

US 2024/0271799 A1 Aug. 15, 2024

(30) Foreign Application Priority Data

Feb. 10, 2023 (KR) ..... 10-2023-0018024

(51) Int. Cl.

| | |
|---|---|
| ***F24F 1/0325*** | (2019.01) |
| ***F24F 1/028*** | (2019.01) |
| ***F24F 13/22*** | (2006.01) |
| *F24F 13/20* | (2006.01) |

(52) U.S. Cl.

CPC ..... *F24F 1/0325* (2019.02); *F24F 1/028* (2019.02); *F24F 13/222* (2013.01); *F24F 13/20* (2013.01); *F24F 2221/14* (2013.01); *F24F 2221/17* (2013.01)

(58) Field of Classification Search

CPC ..... F24F 1/0325; F24F 1/028; F24F 1/0047; F24F 1/0057; F24F 13/22; F24F 13/222; F24F 13/20; F24F 13/082; F24F 2221/14; F24F 2221/17

See application file for complete search history.

(56) References Cited

FOREIGN PATENT DOCUMENTS

| | | | |
|---|---|---|---|
| JP | H06-241492 | A | 8/1994 |
| JP | 2005-265332 | A | 9/2005 |
| KR | 10-2003-0043032 | A | 6/2003 |
| KR | 20-2013-0001087 | A | 2/2013 |

OTHER PUBLICATIONS

Machine translation JP 2005265332 (Year: 2005).*
Machine translation JP 06241492 (Year: 1994).*
Machine translation KR 20030043032 (Year: 2003).*
Office Action in Korean Appln. No. 10-2023-0018024, mailed on Sep. 19, 2024, 8 pages (with English translation).

* cited by examiner

*Primary Examiner* — Joseph F Trpisovsky
(74) *Attorney, Agent, or Firm* — Fish & Richardson P.C.

(57) ABSTRACT

An air conditioner includes a case, a fan disposed inside the case, a heat exchanger, a first drain pan, and a second drain pan. The case is configured to a first position or a second position. The heat exchanger is (i) spaced apart from the fan in a first direction based on the case being fixed in the first position and (ii) spaced apart from the fan in a second direction based on the case being fixed in the second position. The second direction intersects with the first direction. The first drain pan is disposed at a lateral side end of the heat exchanger based on the case being fixed in the second position. The second drain pan is detachably coupled to the case and disposed below the heat exchanger based on the case being fixed in the second position.

19 Claims, 22 Drawing Sheets

AIR CONDITIONER

CROSS-REFERENCE TO RELATED APPLICATION

This application claims priority to and the benefit of Korean Patent Application No. 10-2023-0018024, filed on Feb. 10, 2023, the disclosure of which is incorporated herein by reference in its entirety.

TECHNICAL FIELD

This disclosure relates to an air conditioner, and more specifically, to an air conditioner equipped with a heat exchanger and a drain pan.

BACKGROUND

An air conditioner is an apparatus that exchanges heat with suctioned air and supplies the heat-exchanged air to a room.

The air conditioner can include a case and a heat exchanger that is disposed inside the case. A drain pan that can receive condensed water generated from the heat exchanger can be disposed on a lower side of the heat exchanger.

An indoor air conditioner can be installed on a ceiling or wall depending on an installation environment. The arrangement of the indoor air conditioner can vary depending on a location where the indoor air conditioner is to be installed. For example, when the indoor air conditioner is installed on a ceiling, the indoor air conditioner can be disposed in a horizontal direction relative to a ground, and when the indoor air conditioner is installed on a wall, the indoor air conditioner can be disposed in a vertical direction relative to the ground.

However, issues associated with a conventional indoor air conditioner can arise when a position of the drain pan is changed based on a different arrangement of the indoor air conditioner. For example, the issues can arise when such position of the drain pan is changed to a position where it is difficult for the drain pan to collect condensed water.

In addition, issues associated with the conventional indoor air conditioner can include difficulty of installing a separate drain pan based on the different arrangement of the indoor air conditioner and difficulty of designing or configuring a structure of the drain pan that addresses the above-mentioned issues.

SUMMARY

An air conditioner can include a case, a fan, a heat exchanger, a first drain pan, and a second drain pan. The case can be configured to be fixed to a first position or a second position that is different from the first position. The fan can be disposed inside the case. The heat exchanger can be, based on the case being fixed in the first position, spaced apart from the fan in a first direction based on the case being fixed in the first position. The heat exchanger can be, based on the case being fixed in the second position, spaced apart from the fan in a second direction. The second direction can intersect with the first direction. The first drain pan can be, based on the case being fixed in the second position, disposed at a lateral side end of the heat exchanger. The second drain pan can be, based on the case being fixed in the second position, detachably coupled to the case and disposed below the heat exchanger.

In some implementations, based on the case being fixed in the first position, the first drain pan can be disposed below the heat exchanger. In some implementations, based on the case being fixed in the first position, the second drain pan can be separated from the case.

In some implementations, the first position can correspond to a position on a ceiling of an indoor space, and the second position can correspond to a position on a wall surface of the indoor space.

In some implementations, the first direction can correspond to a horizontal direction relative to a ground and the second direction can correspond to a vertical direction relative to the ground.

In some implementations, the air conditioner can include a partition wall disposed between the heat exchanger and the fan. For example, an assembly space can be defined between the partition wall and the first drain pan. For example, the second drain pan can be disposed at the assembly space.

In some implementations, the first drain pan and the second drain pan can be detachably coupled to each other.

In some implementations, the first drain pan can include a first plate that faces the heat exchanger and defines a recess on the first plate. The second drain pan can include a second plate that faces the heat exchanger. The second drain pan can also include a first wall that extends from the second plate toward the first drain pan and is coupled to the recess.

In some implementations, the case can include a first side plate that faces the second drain pan and a support plate that is elevated or recessed relative to the first side plate. The support plate and the first side plate can form a tiered arrangement. The support plate can define a drain pan seating portion at a boundary between the support plate and the first side plate.

In some implementations, the case can include a second side plate that faces the second drain pan and defines an insertion groove, and a stopper that is spaced apart from the insertion groove. The second drain pan can include a fixing protrusion portion that can be engaged with the insertion groove.

In some implementations, the first drain pan can include a seating body and the heat exchanger can be disposed at the seating body.

In some implementations, the first drain pan can include a plurality of ribs that are disposed between the heat exchanger and the second drain pan and spaced apart from each other along a longitudinal direction of the heat exchanger.

In some implementations, the heat exchanger can be disposed at an oblique angle relative to an upper side surface of the second drain pan. The second drain pan can include a second wall that is (i) spaced apart from and disposed below the heat exchanger and (ii) inclined in a direction parallel to the heat exchanger.

In some implementations, the second drain pan can include a second plate, a second water discharge port, and a protruding body. The second drain pan can be spaced apart from and disposed below the heat exchanger. The second water discharge port can protrude outward from an outer surface of the second plate. The protruding body can protrude from the second plate and face the second water discharge port.

In some implementations, the second drain pan can include a second plate, a second wall, and a fence. The second plate can be spaced apart from and disposed below the heat exchanger. The second wall can extend from the second plate toward the heat exchanger. The fence can protrude upward from the second wall.

In some implementations, the first drain pan can include a packing portion configured to receive the heat exchanger and a packing supporter disposed below the packing portion.

In some implementations, the first drain pan can include a packing portion, a first plate, a first supporter wall, a second supporter wall, and a supporting rib. The packing portion can be configured to receive the heat exchanger. The first plate can be spaced apart from and disposed below the heat exchanger. The first supporter wall can protrude upward from the first plate. The second supporter wall can protrude upward from the first plate and can be spaced apart from the first supporter wall. The supporting rib can be disposed between the first supporter wall and the second supporter wall and receive the packing portion.

In some implementations, the first drain pan can include a first upper body, a first lower body, and a trench. The first upper body can face the heat exchanger. The first lower body can be coupled to the first upper body and made of an insulating material. The trench can be defined between the first upper body and the first lower body.

In some implementations, based on the case being fixed in the first position, the air conditioner can include an air guide that is detachably coupled to the case. In some implementations, based on the case being fixed in the second position, the air guide can be configured to be interchangeably used with the second drain pan. In some implementations, the air guide can be disposed between the fan and the heat exchanger.

DETAILED DESCRIPTION

Figure 1:
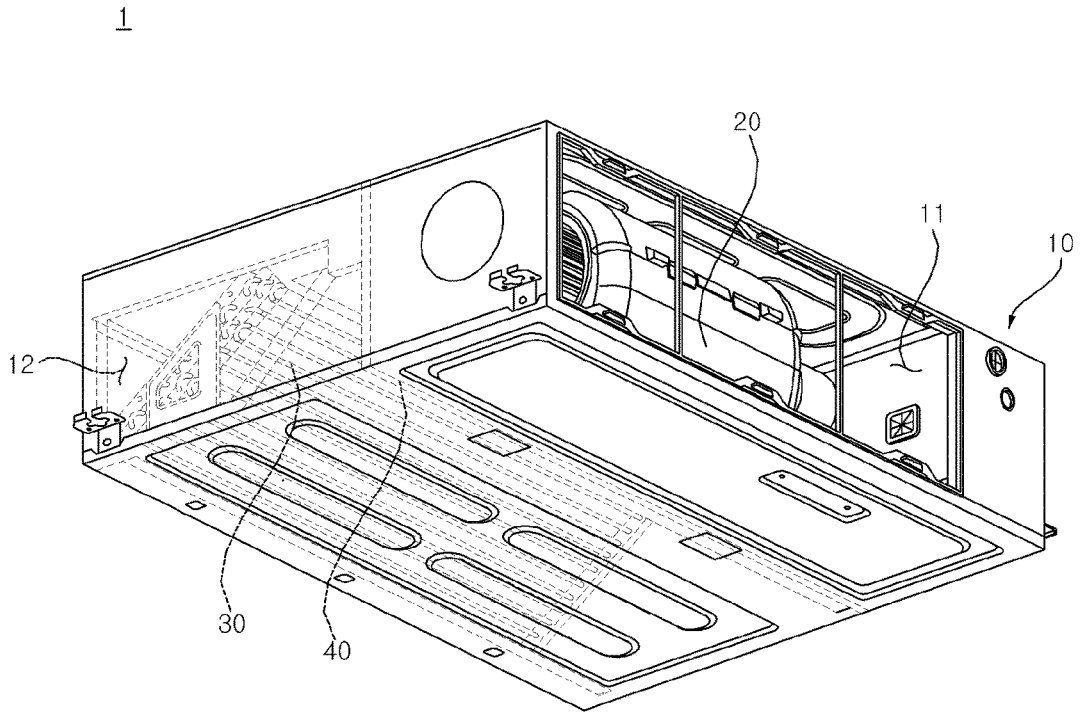
FIG. 1 is a diagram illustrating a perspective view of an example of an indoor air conditioner.

FIG. 1 is a diagram illustrating a perspective view of an example of an indoor air conditioner.

The indoor air conditioner 1 can include a case 10. The case 10 can define a space therein.

The indoor air conditioner 1 can include a suction port 11. The suction port 11 can be open in the case 10.

The indoor air conditioner 1 can include a discharge port 12. The discharge port 12 can correspond to or define an opening at the case 10.

The air flowed into the case 10 through the suction port 11 can escape or be discharged from the case 10 through the discharge port 12.

The indoor air conditioner 1 can include a fan device 20. The fan device 20 can be disposed inside the case 10. The fan device 20 can face the suction port 11.

The indoor air conditioner 1 can include a heat exchanger 30. The heat exchanger 30 can be disposed inside the case 10. The heat exchanger 30 can be disposed between the fan device 20 and the discharge port 12.

The indoor air conditioner 1 can include a partition wall 40. The partition wall 40 can be disposed inside the case 10. The partition wall 40 can be disposed between the fan device 20 and the heat exchanger 30.

Figure 2:
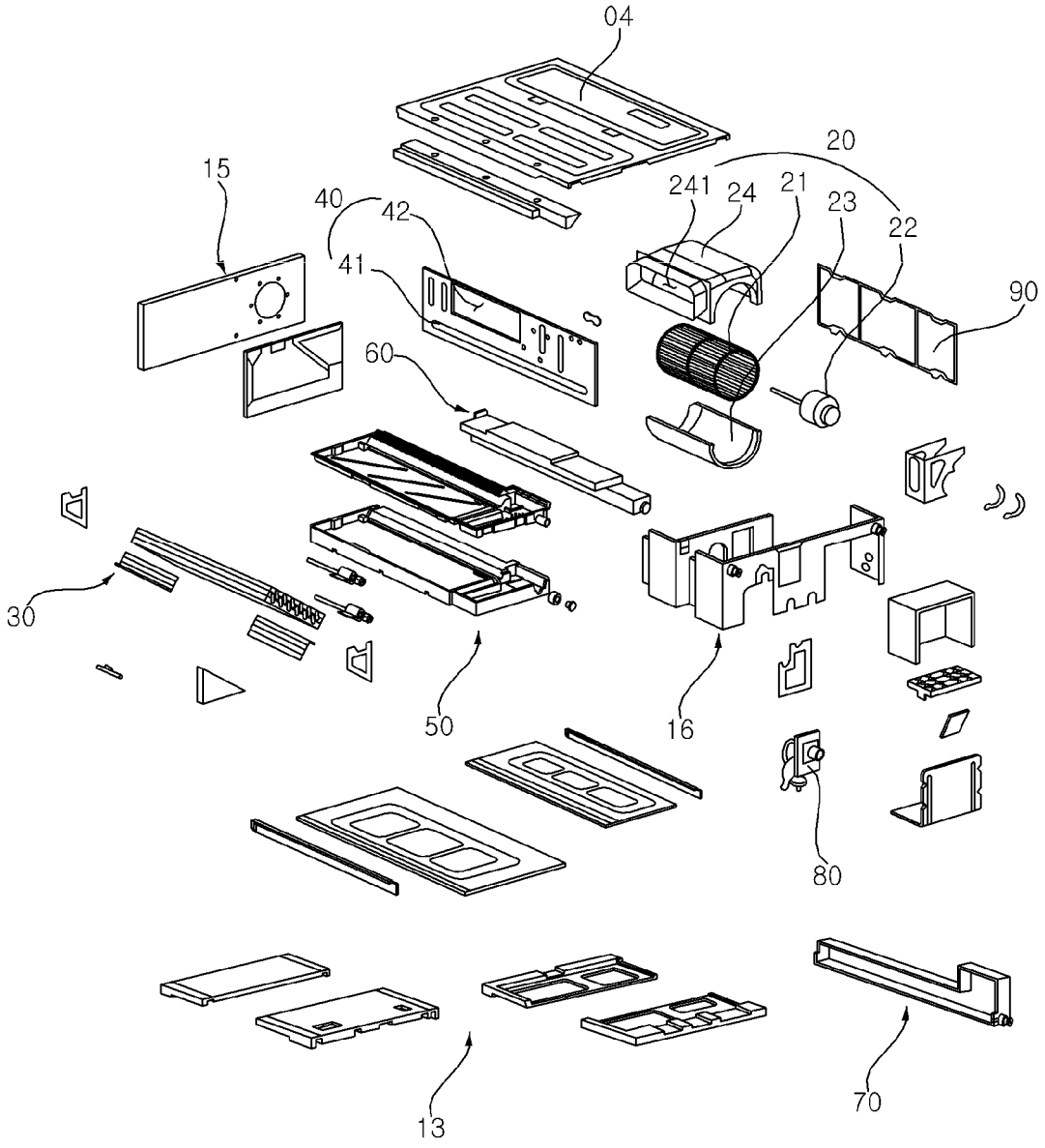
FIG. 2 is a diagram illustrating an exploded view of an example of an indoor air conditioner.

FIG. 2 is a diagram illustrating an exploded view of an example of an indoor air conditioner (e.g., the indoor air conditioner 1).

The case 10 can include a lower panel 13. The lower panel 13 can form a lower surface of the case 10.

The case 10 can include an upper panel 14. The upper panel 14 can form an upper surface of the case 10.

The case 10 can include a first side panel 15. The first side panel 15 can form a side surface of the case 10.

The case 10 can include a second side panel 16. The second side panel 16 can form a side surface of case 10.

The fan device 20 can be disposed inside the case 10. The fan device 20 can generate an air flow.

The fan device 20 can include a fan 21. The fan 21 can be rotatably disposed, for example, at a fan cover 23 and/or at a discharge body 24. In some implementations, the fan 21 can be a cross-flow fan.

The fan device 20 can include a fan motor 22. The fan motor 22 can rotate the fan 21.

The fan device 20 can include the fan cover 23. For example, the fan cover 23 can surround the fan 21.

The fan device 20 can include the discharge body 24. The discharge body 24 can be connected to the fan cover 23. The discharge body 24 can include an air vent 241. The air vent 241 can be open in one side of the discharge body 24.

The partition wall 40 can be connected to the fan device 20. The discharge body 24 can be coupled to the partition wall 40.

The partition wall 40 can include a barrier 41. The barrier 41 can be plate-shaped. The barrier 41 can be disposed between the fan device 20 and the heat exchanger 30.

The partition wall 40 can include a device coupling portion 42. The device coupling portion 42 can correspond to or define an opening at the barrier 41. The discharge body 24 can penetrate the device coupling portion 42 and extend toward the heat exchanger 30.

The indoor air conditioner 1 can include a first drain pan 50. The first drain pan 50 can be disposed below the heat exchanger 30.

The indoor air conditioner 1 can include an air guide 60. The air guide 60 can be detachably coupled to the first drain pan 50.

The indoor air conditioner 1 can include a second drain pan 70. The second drain pan 70 can be disposed below the heat exchanger 30. The second drain pan 70 can be detachably coupled to the first drain pan 50.

The indoor air conditioner 1 can include a pump 80. The pump 80 can be connected to the drain pan 50, 70. The pump 80 can discharge condensed water that is collected inside the drain pan 50, 70.

The indoor air conditioner 1 can include a filter 90. The filter 90 can be disposed at the suction port 11 (as illustrated in FIG. 1).

Figure 3:
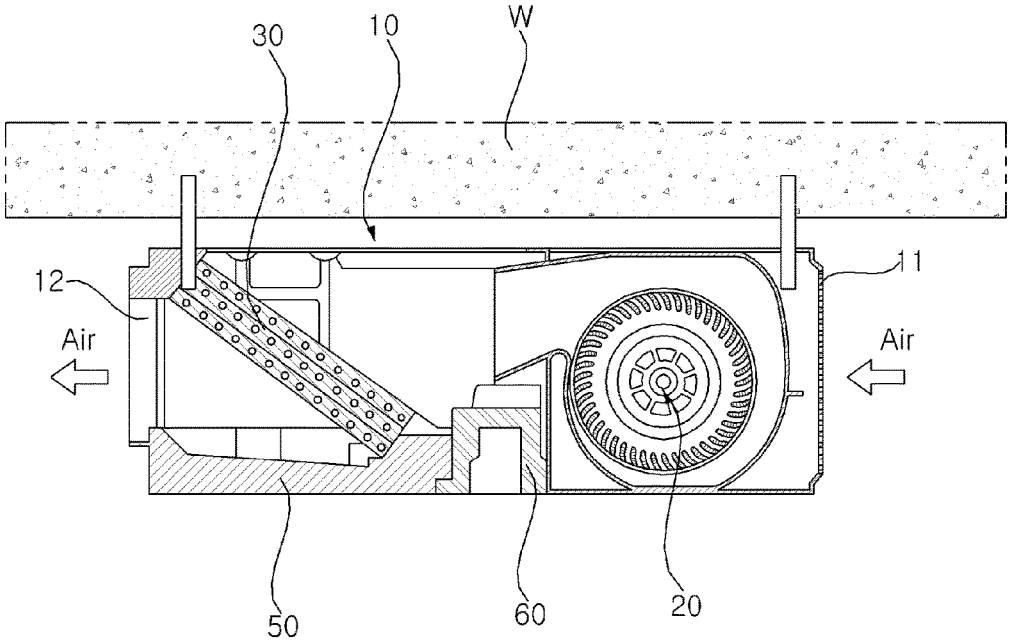
FIG. 3 is a diagram illustrating a cross-sectional view of an example of an indoor air conditioner that is installed on a ceiling.

FIG. 3 is a diagram illustrating a cross-sectional view of an example of an indoor air conditioner that is installed on a ceiling.

The indoor air conditioner 1 can be installed on a ceiling W. The case 10 can be fixed to the ceiling W.

The suction port 11 and the discharge port 12 can be spaced apart from each other in a horizontal direction relative to the ceiling W or the ground. Indoor air (e.g., air of an indoor space) can flow in the horizontal direction to or within the case 10.

The fan device 20 can be arranged in the horizontal direction relative to the ceiling W or the ground. The fan device 20 can be arranged in the horizontal direction with the suction port 11. The fan device 20 can be disposed closer to the suction port 11 than the discharge port 12.

The heat exchanger 30 can be arranged at an oblique angle with respect to the first drain pan 50, the ground, the ceiling W, or any side of the case 10.

In some implementations, the heat exchanger 30 can be arranged in the horizontal direction relative to the ceiling W or the ground. The heat exchanger 30 can be arranged in the horizontal direction with the discharge port 12. The heat exchanger 30 can be disposed closer to the discharge port 12 than the suction port 11.

The first drain pan 50 can be disposed below the heat exchanger 30. The first drain pan 50 can collect condensed water generated in the heat exchanger 30.

The air guide 60 can be disposed between the fan device 20 and the heat exchanger 30. The air guide 60 can be coupled with the first drain pan 50. The air blown (or the air flow generated) from the fan device 20 can flow into the heat exchanger 30 along the air guide 60.

Figure 4:
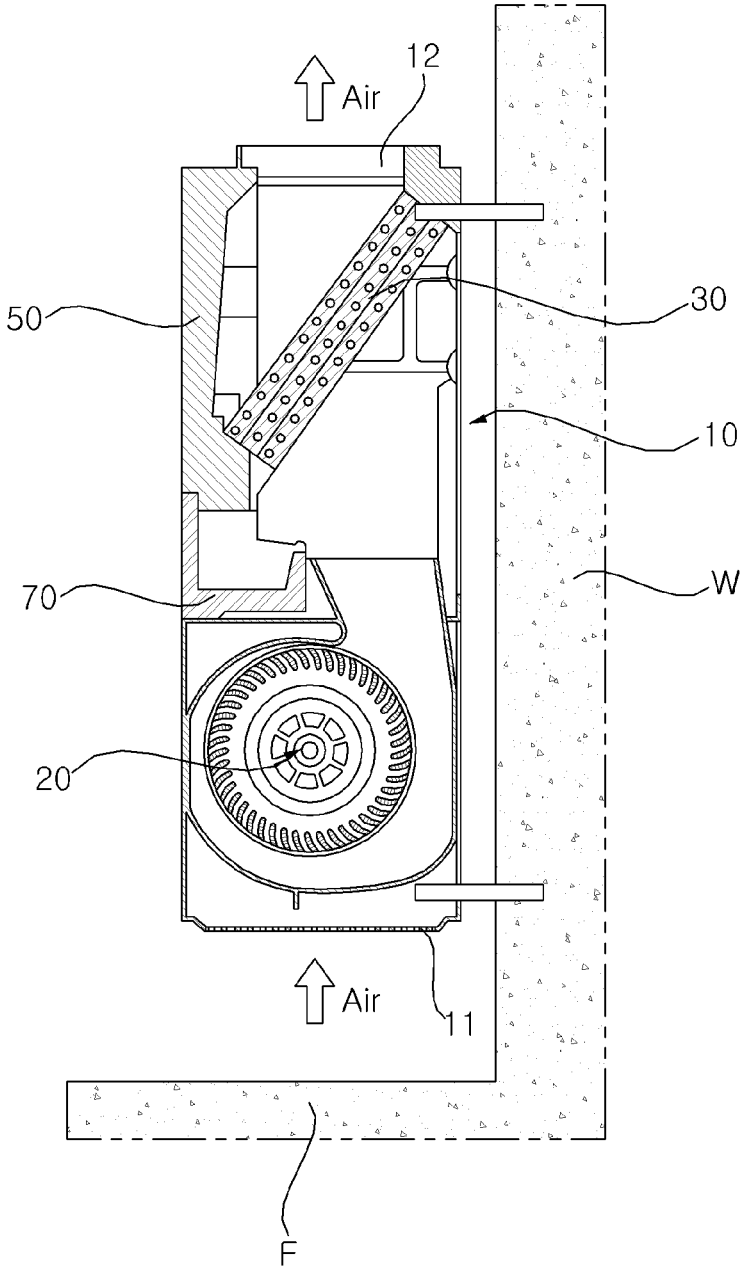
FIG. 4 is a diagram illustrating a cross-sectional view of an example of an indoor air conditioner that is installed on a wall.

FIG. 4 is a diagram illustrating a cross-sectional view of an example of an indoor air conditioner that is installed on a wall.

The indoor air conditioner 1 can be installed on a wall W. For example, the case 10 can be fixed to or mounted on the wall W.

The suction port 11 and the discharge port 12 can be spaced apart from each other in a vertical direction relative to the ground. The indoor air can flow in the vertical direction to or within the case 10.

The fan device 20 can be arranged in a direction perpendicular to the suction port 11. The fan device 20 can be disposed closer to the suction port 11 than the discharge port 12. The suction port 11 can be spaced upward from the ground (e.g., bottom F).

The heat exchanger 30 can be arranged at an oblique angle with respect to the first drain pan 50, the ground, the wall W, or any side of the case 10.

In some implementations, the heat exchanger 30 can be arranged in a direction perpendicular to the discharge port 12.

The heat exchanger 30 can be disposed closer to the discharge port 12 than the suction port 11.

The first drain pan 50 can be disposed at a lateral side of the heat exchanger 30. The heat exchanger 30 can be disposed between the wall W and the first drain pan 50.

The second drain pan 70 can be disposed below the heat exchanger 30. The second drain pan 70 can be disposed between the fan device 20 and the heat exchanger 30. The second drain pan 70 can collect condensed water generated in the heat exchanger 30.

Figure 5:
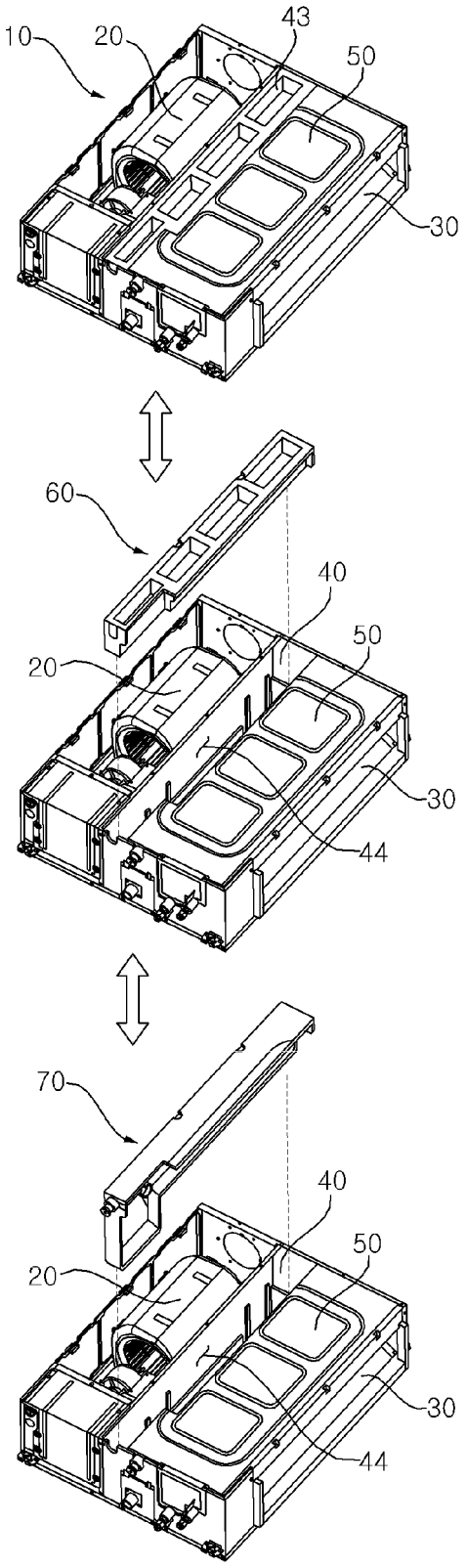
FIG. 5 is a diagram illustrating an assembly of drain pans and an air guide of an example of an indoor air conditioner.

FIG. 5 is a diagram illustrating an assembly of drain pans and an air guide of an example of an indoor air conditioner.

The air guide 60 can be separated from the indoor air conditioner 1. The second drain pan 70 can be separated from the indoor air conditioner 1.

When the indoor air conditioner 1 is disposed on the ceiling (as illustrated in FIG. 3), the air guide 60 can be disposed inside the case 10 in supplant of, or rather than, the second drain pan 70 being disposed inside the case 10.

When the indoor air conditioner 1 is disposed on the wall (as illustrated in FIG. 4), the second drain pan 70 can be disposed inside the case 10 in supplant of, or rather than, the air guide 60 being disposed inside the case 10.

The indoor air conditioner 1 can include a cover 43. The cover 43 can cover the inner space of the case 10. The air guide 60 can be covered or concealed by the cover 43. The second drain pan 70 can be covered or concealed by the cover 43.

The air guide 60 can be disposed between the partition wall 40 and the first drain pan 50. The second drain pan 70 can be disposed between the partition wall 40 and the first drain pan 50.

The indoor air conditioner 1 can define an assembly space 44. The assembly space 44 can be defined between the partition wall 40 and the first drain pan 50. The air guide 60 or the second drain pan 70 can be inserted into the assembly space 44.

When the indoor air conditioner 1 is disposed on the wall (as illustrated in FIG. 4), the air guide 60 can be separated from the indoor air conditioner 1. A user can remove the cover 43 to withdraw or take out the air guide 60 from the inside of the case 10.

When the indoor air conditioner 1 is disposed on the wall (as illustrated in FIG. 4), the second drain pan 70 can be mounted in the indoor air conditioner 1. A user can insert the second drain pan 70 into a position between the partition wall 40 and the first drain pan 50 and then close the cover 43.

Figure 6:
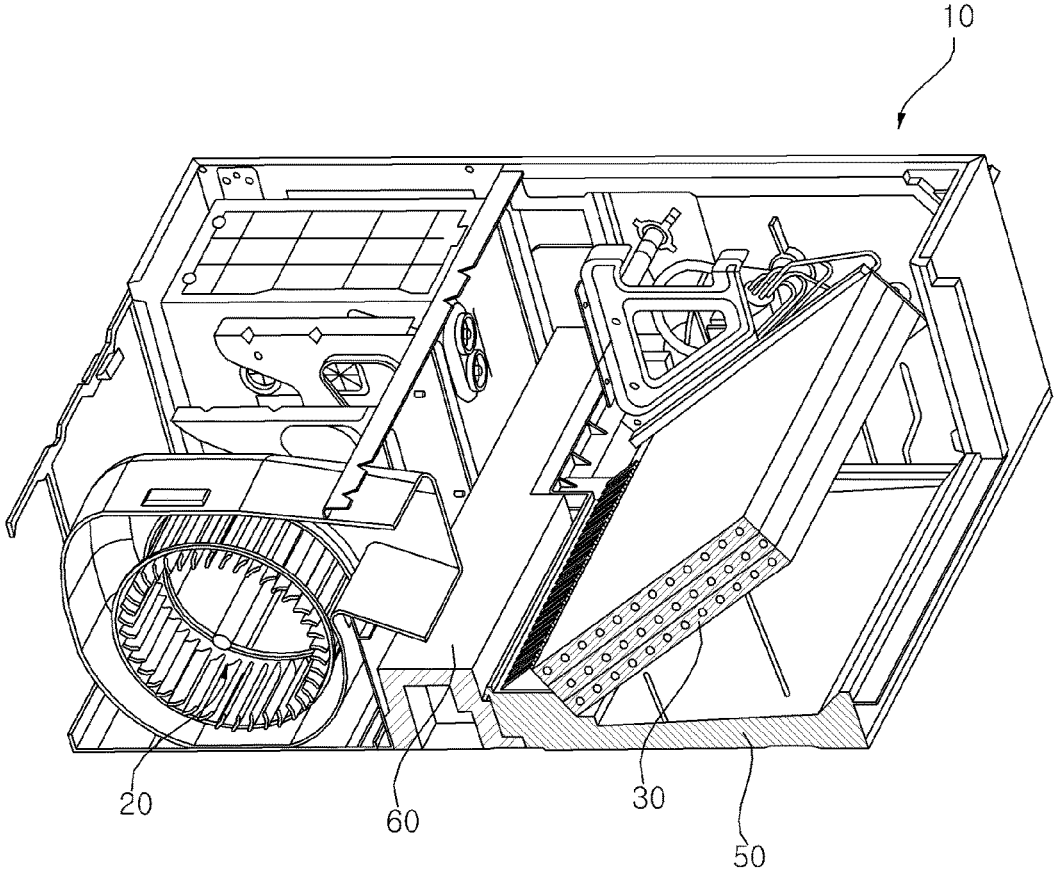
FIG. 6 is a diagram illustrating an internal structure of an example of an indoor air conditioner.

FIG. 6 is a diagram illustrating an internal structure of an example of an indoor air conditioner. For example, FIG. 6 illustrates the indoor air conditioner 1 when it is disposed in the horizontal direction or installed on the ceiling (as illustrated in FIG. 3).

The fan device 20 can blow air or generate air flow toward the heat exchanger 30. The air guide 60 can be disposed between the fan device 20 and the heat exchanger 30. The air blown (or the air flow generated) from the fan device 20 can flow to the heat exchanger 30 along the surface of the air guide 60.

The first drain pan 50 can be disposed below the heat exchanger 30. Condensed water generated in the heat exchanger 30 can fall into (e.g., drip into), or collected in, the first drain pan 50.

Figure 7:
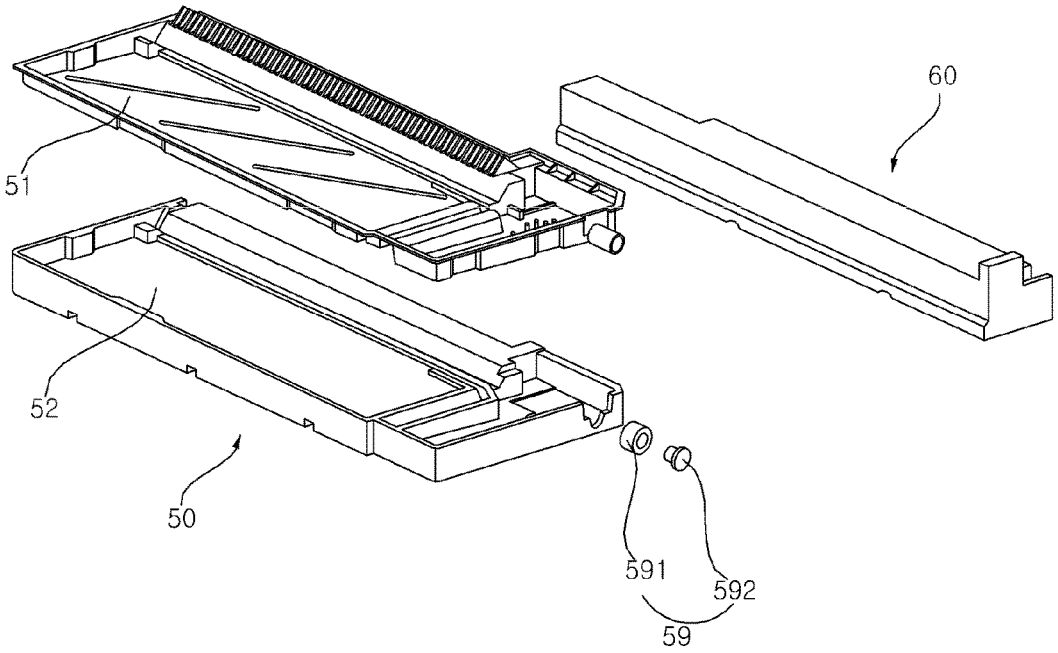
FIG. 7 is a diagram illustrating an exploded view of a first drain pan of an example of an indoor air conditioner.

FIG. 7 is a diagram illustrating an exploded view of a first drain pan of an example of an indoor air conditioner. For example, FIG. 7 illustrates the first drain pan 50 in a disassembled state and the air guide 60.

The first drain pan 50 can include a first upper body 51. The first upper body 51 can face the heat exchanger 30.

The first drain pan 50 can include a first lower body 52. The first lower body 52 can be coupled to the first upper body 51.

The first drain pan 50 can include a first water discharge port 59. The first water discharge port 59 can protrude from the first lower body 52.

The first water discharge port 59 can include a first insulating material 591. The first insulating material 591 can have a cylindrical shape.

The first water discharge port 59 can include a first louver 592. The first louver 592 can be coupled with the first insulation material 591.

Figure 8:
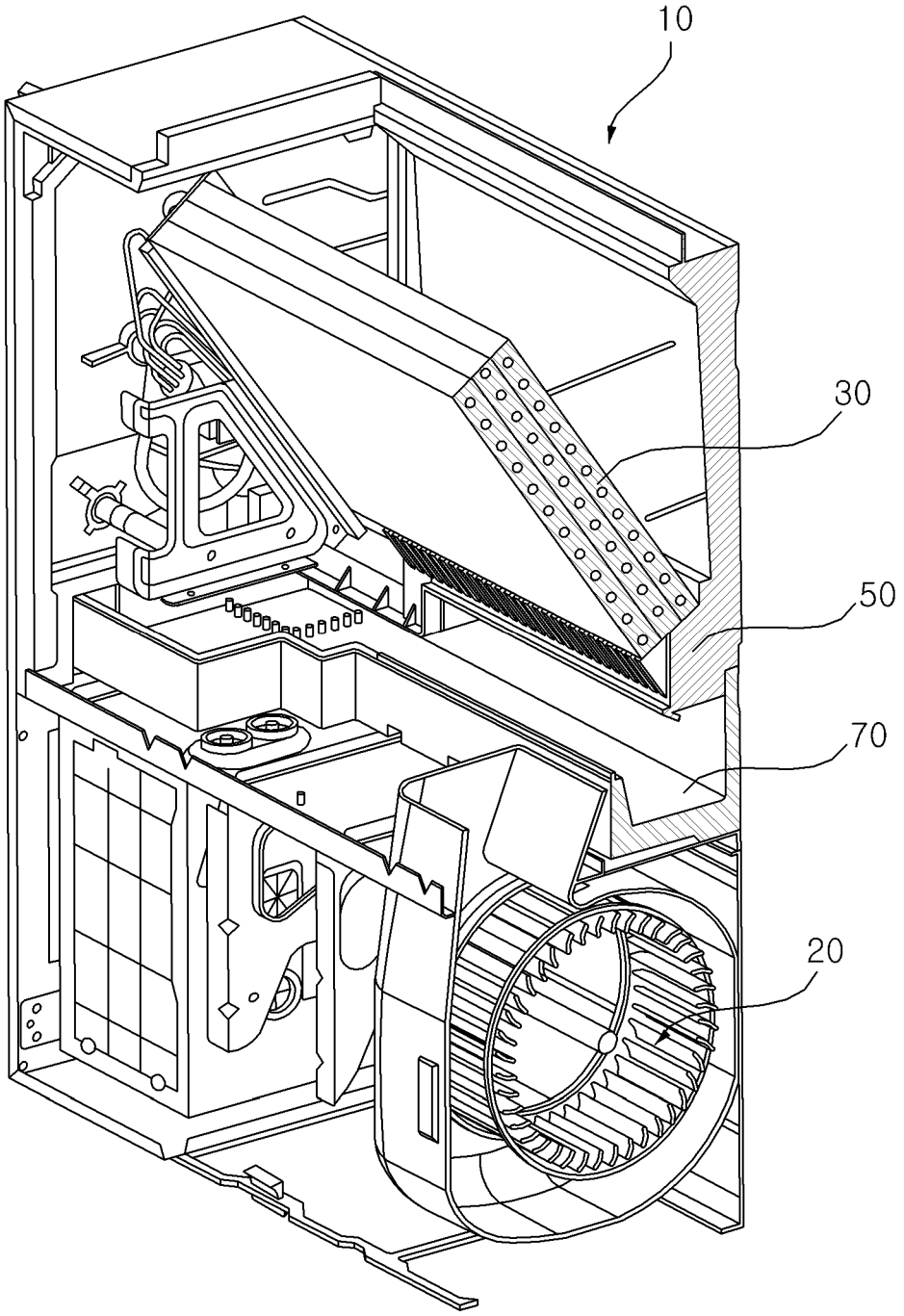
FIG. 8 is a diagram illustrating an internal structure of an example of an indoor air conditioner.

FIG. 8 is a diagram illustrating an internal structure of an example of an indoor air conditioner.

For example, FIG. 8 illustrates the internal structure of the indoor air conditioner 1 when it is disposed in the vertical direction or installed on the wall (as illustrated in FIG. 4).

The fan device 20 can blow air or generate air flow toward the heat exchanger 30. The second drain pan 70 can be disposed between the fan device 20 and the heat exchanger 30. The air blown (or the air flow generated) from the fan device 20 can flow to the heat exchanger 30 along the surface of the second drain pan 70.

The first drain pan 50 can be disposed in the lateral side of the heat exchanger 30. The second drain pan 70 can be disposed below the heat exchanger 30. Condensed water generated in the heat exchanger 30 can fall into, or collected in, the second drain pan 70.

Figure 9:
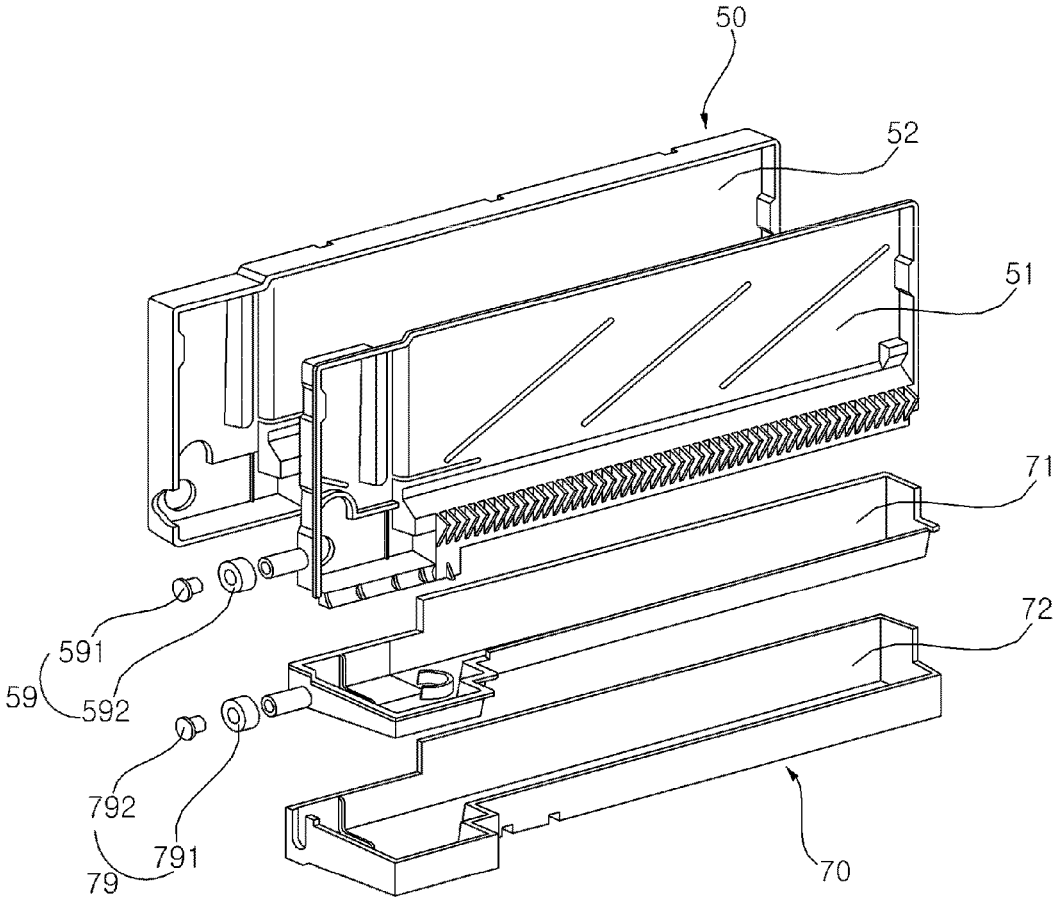
FIG. 9 is a diagram illustrating an exploded view of drain pans of an example of an indoor air conditioner.

FIG. 9 is a diagram illustrating an exploded view of drain pans of an example of an indoor air conditioner. For example, FIG. 9 illustrates an exploded view of the first drain pan 50 and the second drain pan 70.

The second drain pan 70 can include a second upper body 71. The second upper body 71 can face the heat exchanger 30.

The second drain pan 70 can include a second lower body 72. The second lower body 72 can be coupled to the second upper body 71.

The second drain pan 70 can include a second water discharge port 79. The second water discharge port 79 can protrude from the second lower body 72.

The second water discharge port 79 can include a second insulating material 791. The second insulating material 791 can have a cylindrical shape.

The second water discharge port 79 can include a second louver 792. The second louver 792 can be coupled with the second insulation material 791.

Figure 10:
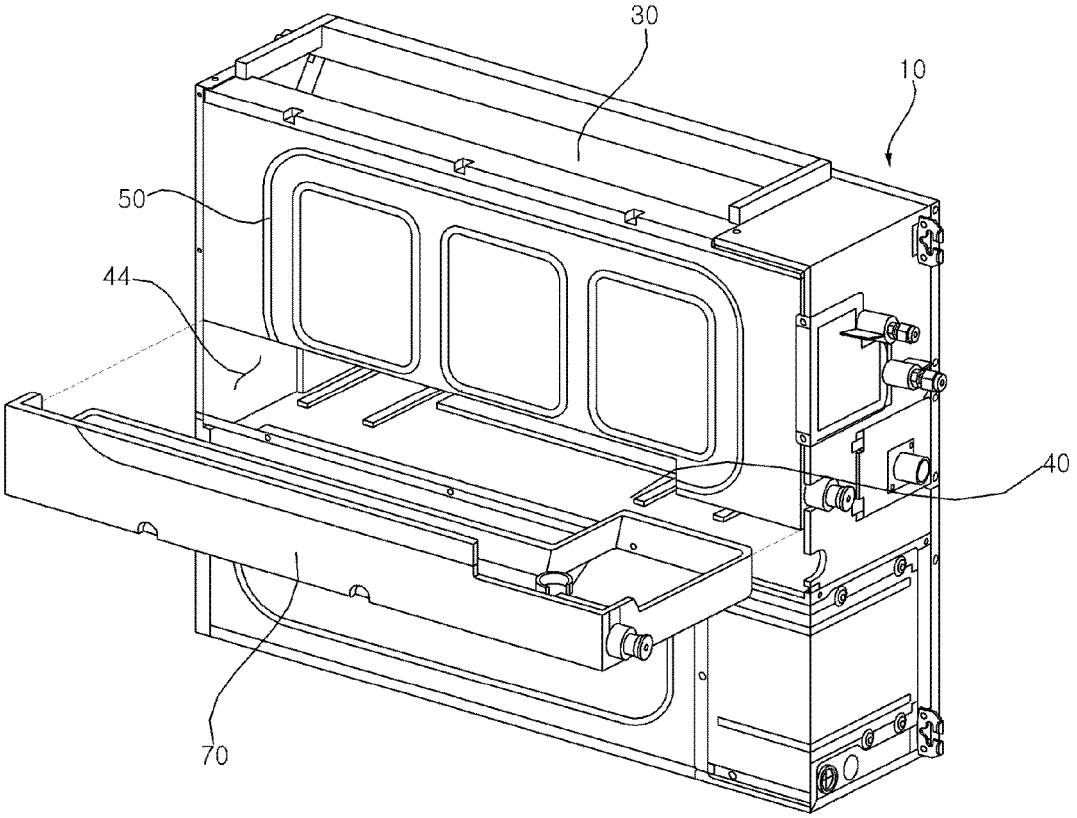
FIG. 10 is a diagram illustrating an example of an indoor air conditioner.
Figure 11:
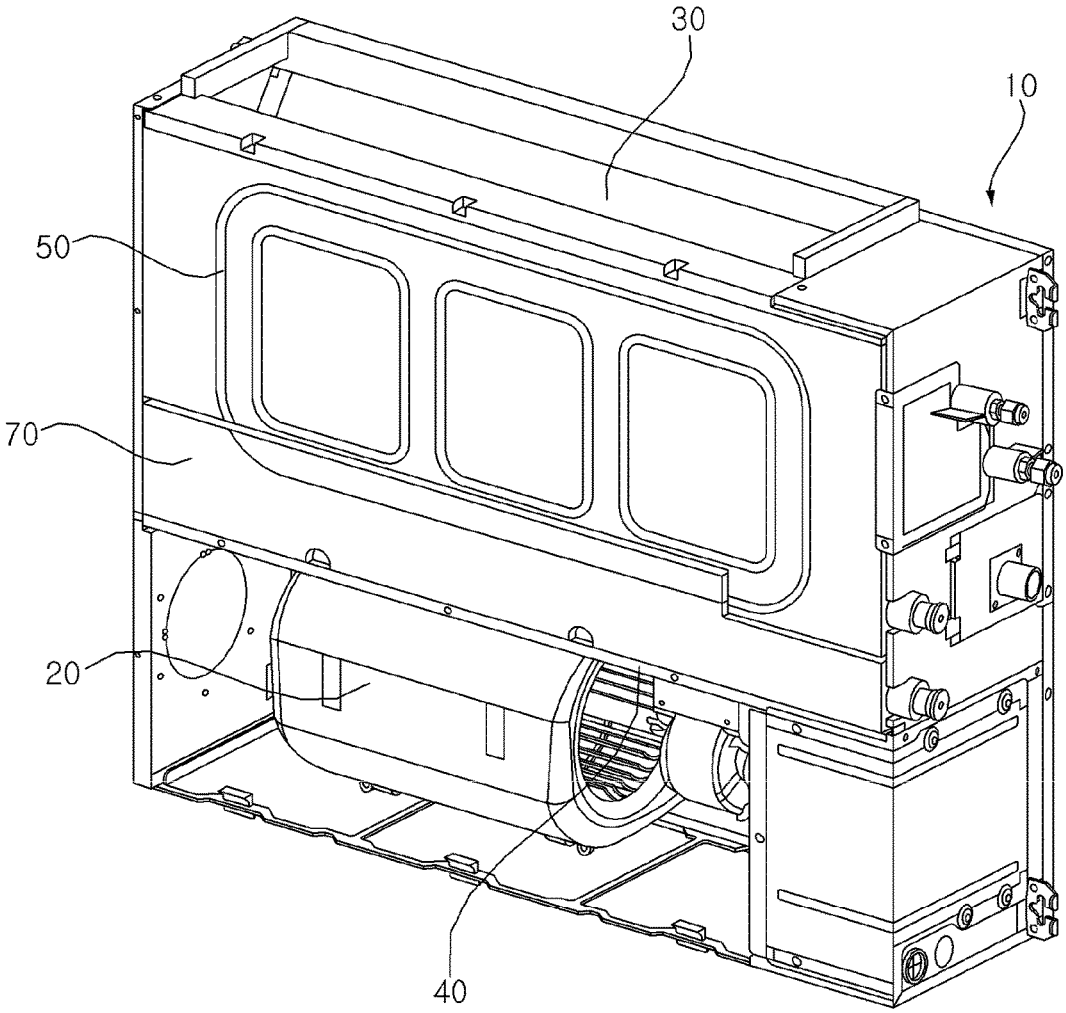
FIG. 11 is a diagram illustrating an example of an indoor air conditioner.

FIGS. 10 and 11 are diagrams illustrating an example of an indoor air conditioner.

For example, FIG. 10 illustrates the indoor air conditioner 1 before the second drain pan 70 is assembled.

For example, FIG. 11 illustrates the indoor air conditioner 1 after the second drain pan 70 is assembled.

The indoor air conditioner 1 can define an assembly space 44. The assembly space 44 can be defined between the partition wall 40 and the first drain pan 50.

The second drain pan 70 can be inserted into the assembly space 44. The second drain pan 70 can be fixed to the case 10 within the assembly space 44.

Figure 12:
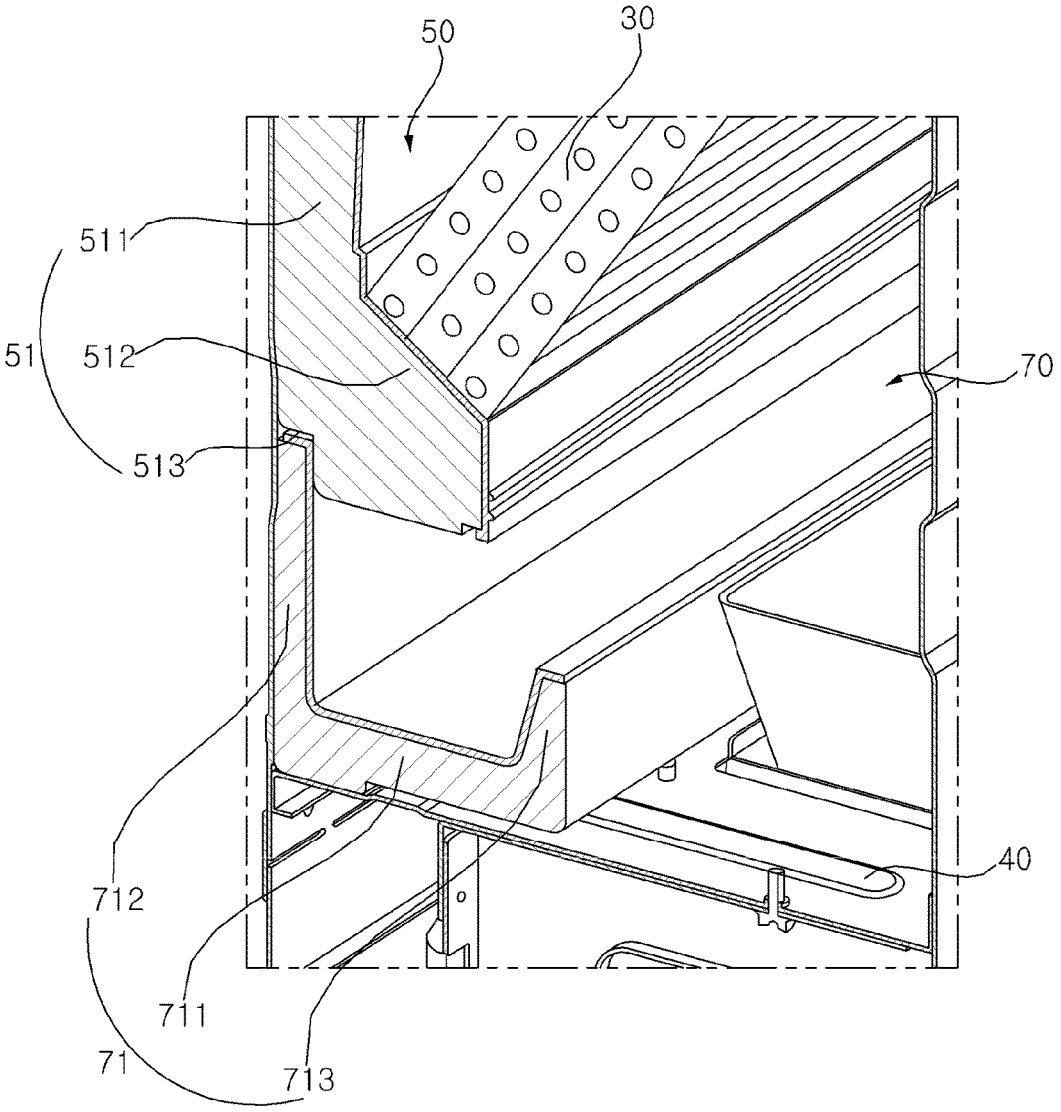
FIG. 12 a diagram illustrating a cross-sectional view of a portion of an example of an indoor air conditioner.
Figure 13:
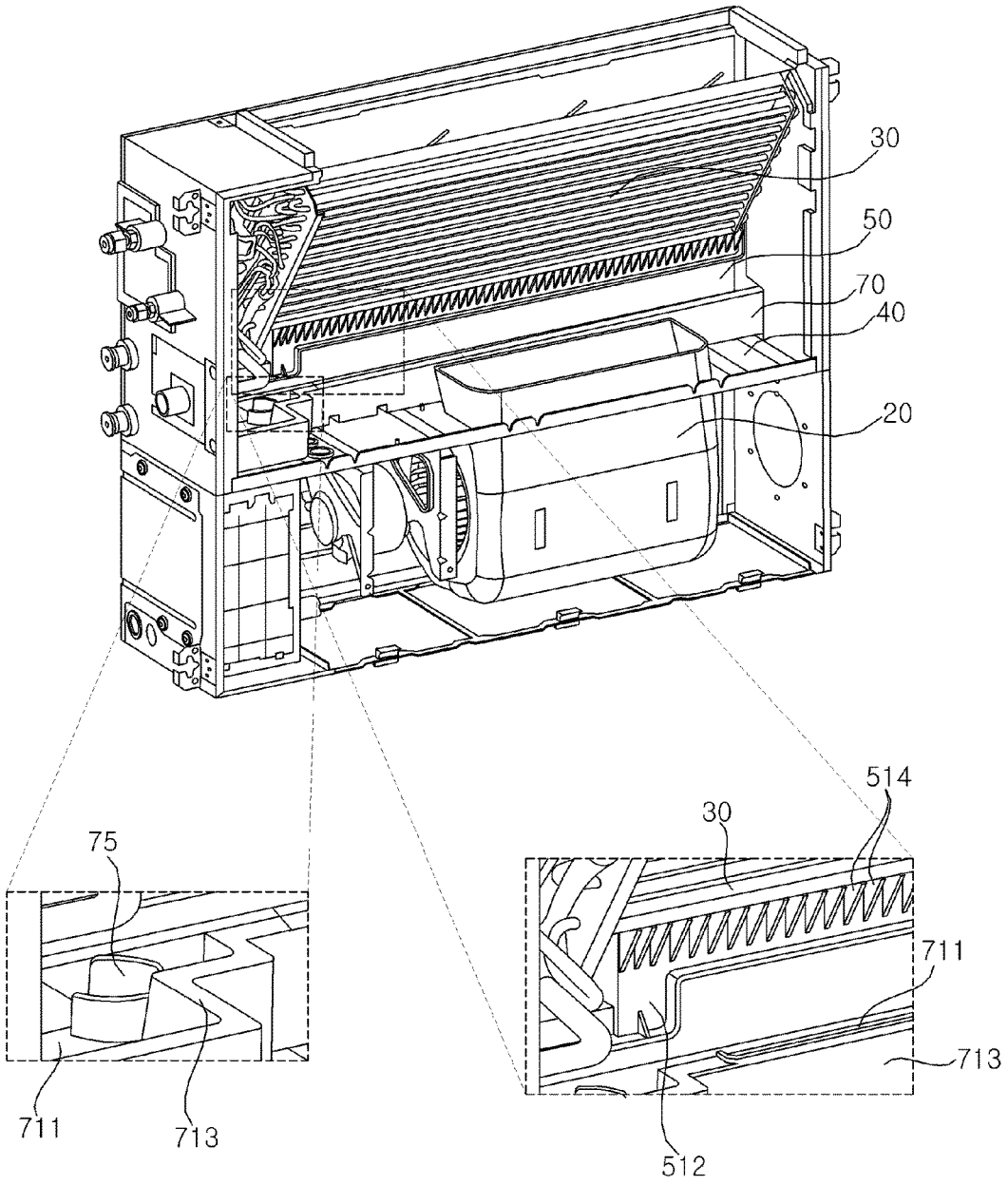
FIG. 13 is a diagram illustrating an enlarged perspective view of a portion of an example of an indoor air conditioner.

FIG. 12 a diagram illustrating a cross-sectional view of a portion of an example of an indoor air conditioner. FIG. 13 is a diagram illustrating an enlarged perspective view of a portion of an example of an indoor air conditioner. For example, FIG. 13 illustrates the internal structure of the indoor air conditioner 1.

The heat exchanger 30 can be disposed on the first drain pan 50. The lower surface of the heat exchanger 30 can be disposed on the first drain pan 50.

The first drain pan 50 can include a first plate 511. The first plate 511 can face the heat exchanger 30.

The first drain pan 50 can include a seating body 512. The seating body 512 can protrude from the first plate 511. The heat exchanger 30 can be disposed in an upper side of the seating body 512.

The first drain pan 50 can include or define a recess 513. For example, the recess 513 can be defined at the first plate 511. For example, the recess 513 can correspond to a recessed surface or portion at the first plate 511.

The second drain pan 70 can be disposed above the partition wall 40. The second drain pan 70 can be disposed below the first drain pan 50 and the heat exchanger 30.

The second drain pan 70 can include a second plate 711. The second plate 711 can be disposed below the heat exchanger 30.

The second drain pan 70 can include a first wall 712. The first wall 712 can extend upward from the second plate 711. The first wall 712 can be disposed in the recess 513.

The second drain pan 70 can include a second wall 713. The second wall 713 can extend upward from the second plate 711. The second wall 713 can be spaced apart from the first wall 712.

The first drain pan 50 can include one or more ribs 514. For example, the one or more ribs 514 may be provided in plurality. The plurality of ribs 514 can protrude from the seating body 512. The plurality of ribs 514 can be disposed and be spaced apart from each other in the longitudinal direction of the heat exchanger 30. The plurality of ribs 514 can be spaced apart from each other on the upper side of the second plate 711.

The second drain pan 70 can include a protruding body 75. The protruding body 75 can protrude upward from the second plate 711. The protruding body 75 can be spaced apart from the second wall 713.

Figure 14:
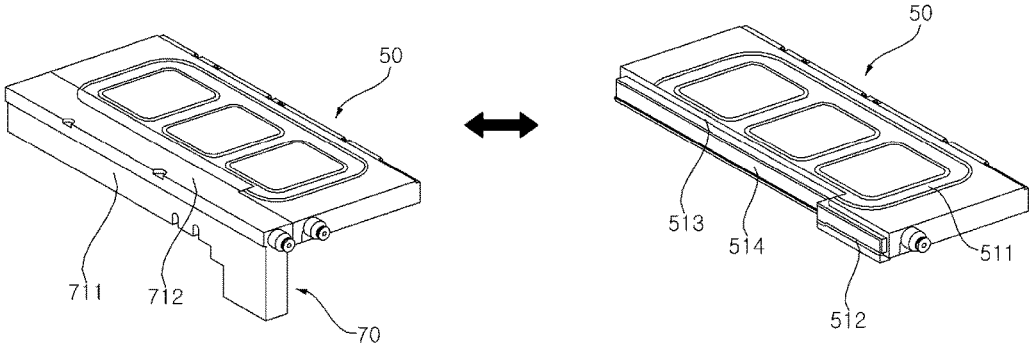
FIG. 14 is a diagram illustrating a perspective view of a drain pan of an example of an indoor air conditioner.

FIG. 14 is a diagram illustrating a perspective view of a drain pan of an example of an indoor air conditioner. For example, FIG. 14 illustrates an assembly of the first drain pan 50 and the second drain pan 70.

The first drain pan 50 can include a first plate 511 and a seating body 512. The first drain pan 50 can include a coupling portion in the form of ribs 514. The first drain pan 50 can include or define a recess 513. For example, the recess 513 can correspond to a recessed surface or portion that is recessed upward from the coupling portion. The coupling portion, for example the plurality of ribs 514, and the recess 513 can form a step or be aligned together.

The second drain pan 70 can be connected to the coupling portion of the first drain pan 50. The upper end of the first wall 712 can be fixed to the recess 513.

Figure 15:
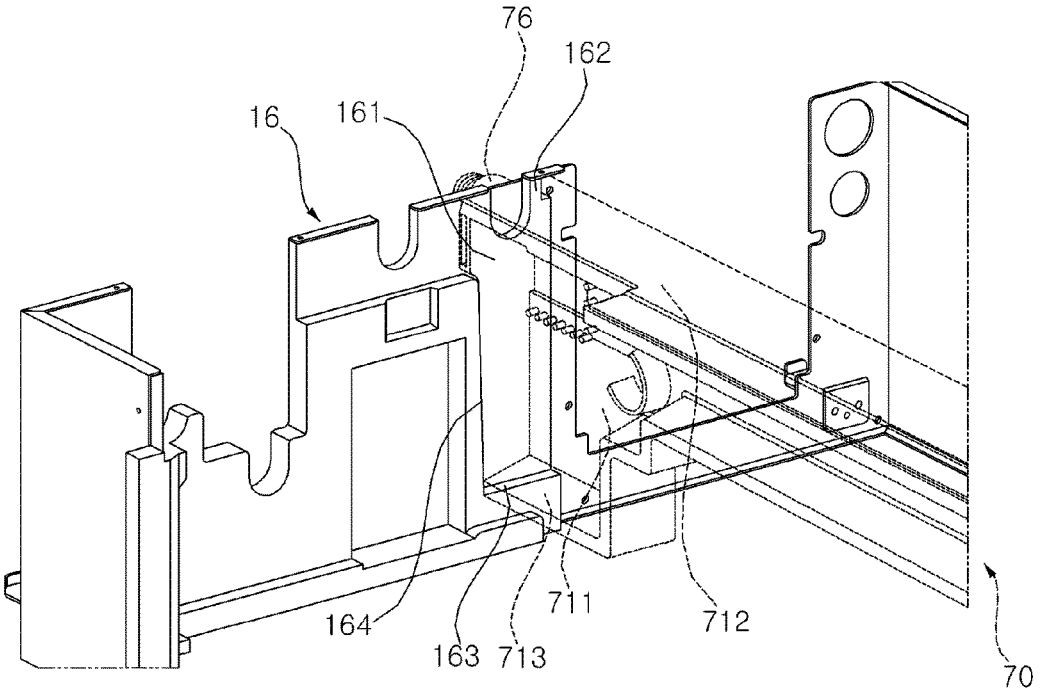
FIG. 15 is a diagram illustrating an assembly of a drain pan and a side panel of an example of an indoor air conditioner.
Figure 16:
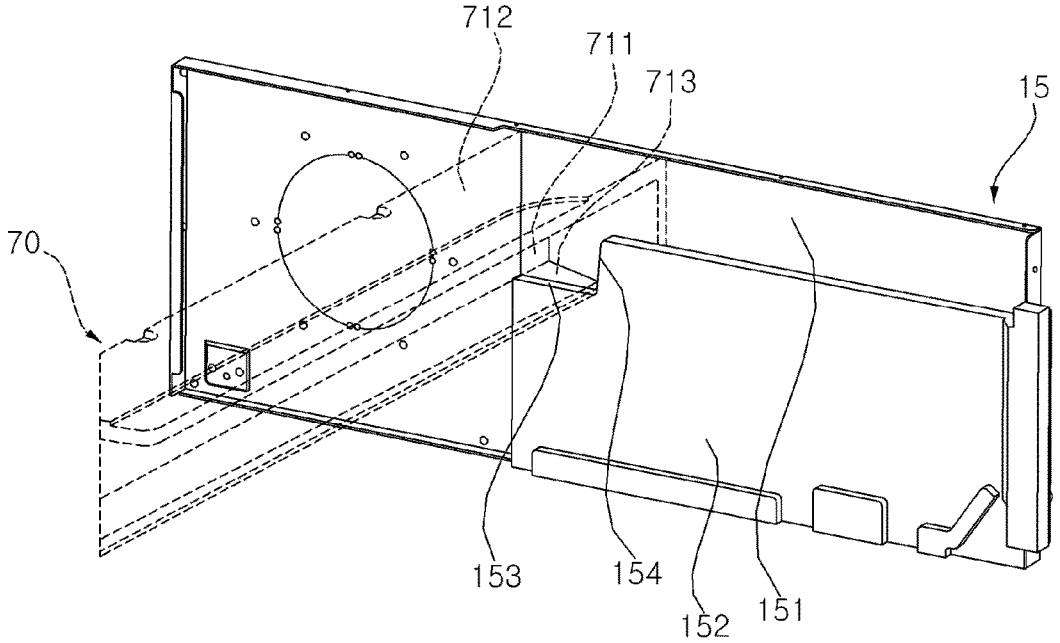
FIG. 16 is a diagram illustrating an assembly of a drain pan and a side panel of an example of an indoor air conditioner.

FIGS. 15 and 16 are diagrams illustrating an assembly of a drain pan and a side panel of an example of an indoor air conditioner. For example, FIG. 15 illustrates the second drain pan 70 that is coupled to the second side panel 16. For example, FIG. 16 illustrates the second drain pan 70 that is coupled to the first side panel 15.

The second drain pan 70 can be coupled to the second side panel 16. A portion of the second drain pan 70 can be inserted into the second side panel 16.

The second side panel 16 can include a second side plate 161. The second side plate 161 can extend in a direction in which the second drain pan 70 is coupled.

The second side panel 16 can include or define an insertion groove 162. The insertion groove 162 can be defined at the second side plate 161. The insertion groove 162 can extend in the direction in which the second drain pan 70 is coupled.

The second side panel 16 can include a stopper 163. The stopper 163 can be formed or disposed at a lower end of the second side plate 161.

The second side panel 16 can include a guide wall 164. The guide wall 164 can be defined or disposed in a lateral edge of the second side plate 161. The guide wall 164 can extend in the direction in which the second drain pan 70 is coupled.

The second drain pan 70 can include or define a fixing protrusion 76. The fixing protrusion 76 can protrude outside of the first wall 712 or toward outer end of the first wall 712. The fixing protrusion 76 can be inserted into, and/or fixed to or fixed inside, the insertion groove 162.

The second wall 713 can be supported by the stopper 163. When the fixing protrusion 76 is inserted into the insertion groove 162, the second wall 713 can be seated or disposed on the stopper 163.

The second drain pan 70 can be coupled to the first side panel 15. A portion of the second drain pan 70 can be mounted or disposed on the first side panel 15.

The first side panel 15 can include a first side plate 151. The first side plate 151 can face the second drain pan 70.

The first side panel 15 can include a support plate 152. The support plate 152 can form a step with or be aligned with the first side plate 151.

The first side panel 15 can include a drain pan seating portion 153. The drain pan seating portion 153 can form a boundary between the first side plate 151 and the support plate 152. The second drain pan 70 can be seated or disposed on the drain pan seating portion 153.

The first side panel 15 can include a support wall 154. The support wall 154 can form a boundary between the first side plate 151 and the support plate 152. The support wall 154 can extend upward from the drain pan seating portion 153.

Figure 17:
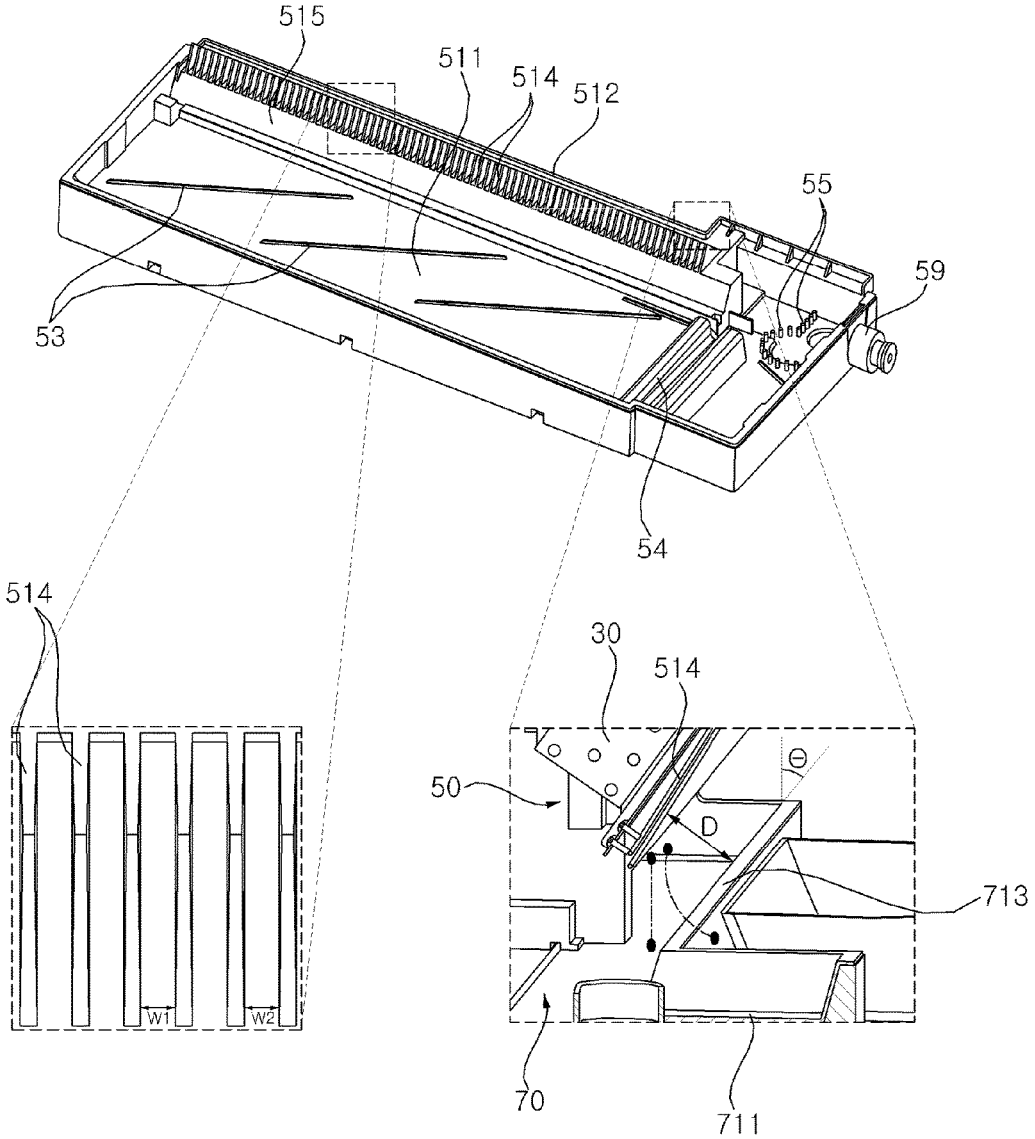
FIG. 17 is a diagram illustrating an enlarged perspective view of a portion of a drain pan of an example of an indoor air conditioner.

FIG. 17 is a diagram illustrating an enlarged perspective view of a portion of a drain pan of an example of an indoor air conditioner. For example, FIG. 17 illustrates an enlarged perspective view of the first drain pan 50 and a portion of the first drain pan 50.

The first drain pan 50 can include a seating surface 515. The seating surface 515 can be disposed at an upper side of the first plate 511. The seating surface 515 can be inclined with respect to the first plate 511. The plurality of ribs 514 can be disposed in one side of the seating surface 515. The heat exchanger 30 can be supported on the seating surface 515.

The first drain pan 50 can include one or more guide ribs 53. The one or more guide ribs 53 can protrude upward from the first plate 511. The one or more guide ribs 53 can extend toward the first water discharge port 59. The one or more guide ribs 53 can be inclined with respect to the direction in which the first plate 511 extends.

The first drain pan 50 can include a packing supporter 54. The packing supporter 54 can protrude from the first plate 511. The packing supporter 54 can be positioned between the guide rib 53 and the first water discharge port 59.

The first drain pan 50 can include or define one or more guide protrusions 55. The one or more guide protrusions 55 can protrude from the first plate 511. The one or more guide protrusions 55 can be provided in plurality. The one or more guide protrusion 55 can be defined or positioned between the first water discharge port 59 and the packing supporter 54.

A plurality of ribs 514 can be spaced apart from each other. The plurality of ribs 514 can be spaced apart from each other in the longitudinal direction of the heat exchanger 30. The gap W1, W2 by which the plurality of ribs 514 are spaced apart from each other can range from 5 mm to 7 mm.

The heat exchanger 30 can be seated or disposed on the first drain pan 50. Condensed water generated in the heat exchanger 30 can escape or be discharged into the space defined between the plurality of ribs 514.

Condensed water that escapes into the space defined between the plurality of ribs 514 can fall to, or be collected in, the second drain pan 70.

The second drain pan 70 can include a second wall 713. The second wall 713 can be spaced apart from the lower side of the plurality of ribs 514. A gap D can be formed between the second wall 713 and the plurality of ribs 514. The second wall 713 and the plurality of ribs 514 can face each other vertically.

The second wall 713 can have an inclination angle θ with respect to the vertical direction. The second wall 713 can be disposed parallel to the plurality of ribs 514. The second wall 713 can be inclined parallel to the direction in which the heat exchanger 30 is inclined.

Figure 18:
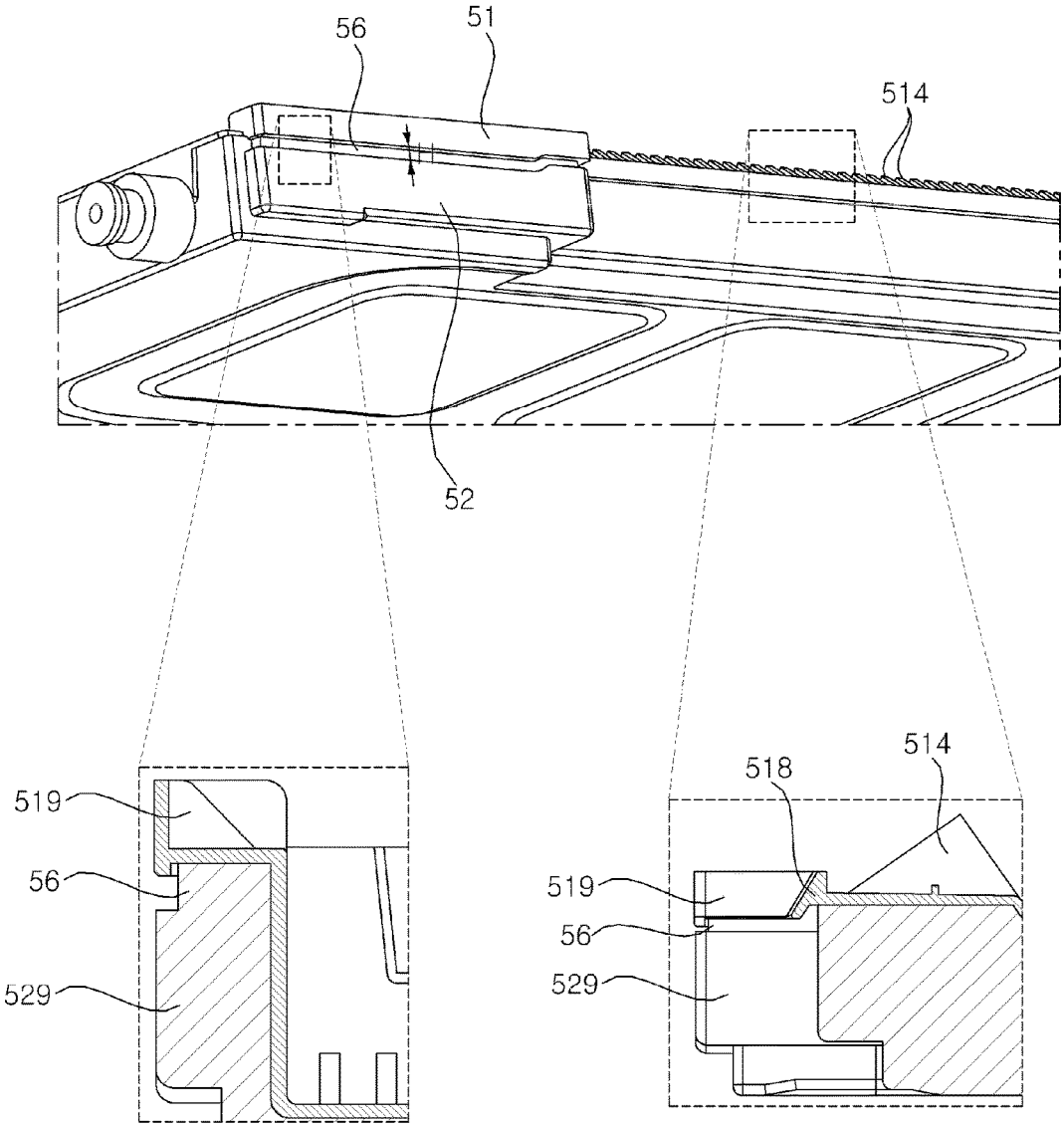
FIG. 18 is a diagram illustrating an enlarged view of an exterior of a drain pan of an example of an indoor air conditioner.

FIG. 18 is a diagram illustrating an enlarged view of an exterior of a drain pan of an example of an indoor air conditioner. For example, FIG. 18 illustrates an enlarged view of the exterior of the first drain pan 50.

The first drain pan 50 can include a first upper body 51 and a first lower body 52. The first lower body 52 can be made of an insulating material.

The first drain pan 50 can include or define a guide passage 56, which can be in the form of a trench. The guide passage 56 can be defined between the first upper body 51 and the first lower body 52. A gap H can be defined between the first upper body 51 and the first lower body 52, and the guide passage 56 can correspond to, or be defined based on, a recession in the gap H.

The first upper body 51 can include a first outer wall 519. The first outer wall 519 can form an outer surface of the first upper body 51.

The first lower body 52 can include a second outer wall 529. The second outer wall 529 can form the outer surface of the first lower body 52.

The guide passage 56 can be defined between the first outer wall 519 and the second outer wall 529. The guide passage 56 can be recessed toward the inside of the first drain pan 50 in the form of a trench.

The first drain pan 50 can include a waterproof portion 518. The waterproof portion 518 can be formed at a boundary between the first upper body 51 and the first lower body 52. The plurality of ribs 514 can be spaced apart from the waterproof portion 518.

Figure 19:
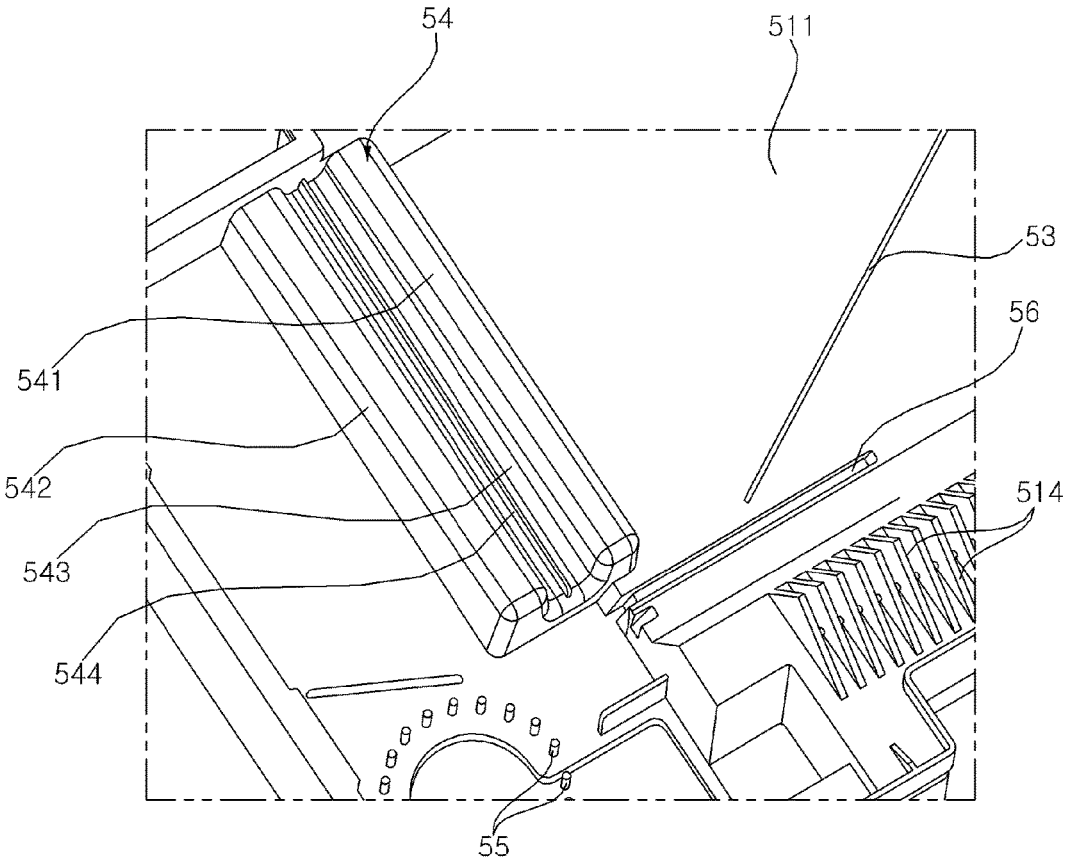
FIG. 19 is a diagram illustrating an enlarged view of a portion of a drain pan of an example of an indoor air conditioner.

FIG. 19 is a diagram illustrating an enlarged view of a portion of a drain pan of an example of an indoor air conditioner. For example, FIG. 19 illustrates an enlarged view of a portion of the first drain pan 50.

The first drain pan 50 can include or define the guide passage 56. The guide passage 56 can correspond to, or be formed based on, a recession or recessed portion at the first plate 511.

The guide passage 56 can extend toward the first water discharge port 59. The guide passage 56 can extend in the longitudinal direction of the first plate 511. The guide passage 56 can be spaced apart from the distal end of the one or more guide ribs 53. The guide passage 56 can face the distal end of the one or more guide ribs 53. The guide passage 56 can be located between the packing supporter 54 and the seating body 512. The packing supporter 54 and the seating body 512 can be spaced apart. The guide passage 56 can face the guide protrusion 55.

The packing supporter 54 can include a first supporter wall 541. The first supporter wall 541 can protrude from the first plate 511. The first supporter wall 541 can extend in a direction intersecting the longitudinal direction of the first plate 511.

The packing supporter 54 can include a second supporter wall 542. The second supporter wall 542 can protrude from the first plate 511. The second supporter wall 542 can extend in a direction intersecting the longitudinal direction of the first plate 511. The first supporter wall 541 and the second supporter wall 542 can be spaced apart from each other.

The packing supporter 54 can include or define a groove 543. The groove 543 can be formed between the first supporter wall 541 and the second supporter wall 542.

The packing supporter 54 can include one or more supporting ribs 544. The one or more supporting ribs 544 can protrude from the groove 543. The one or more supporting ribs 544 can be disposed or defined between the first supporter wall 541 and the second supporter wall 542.

Figure 20:
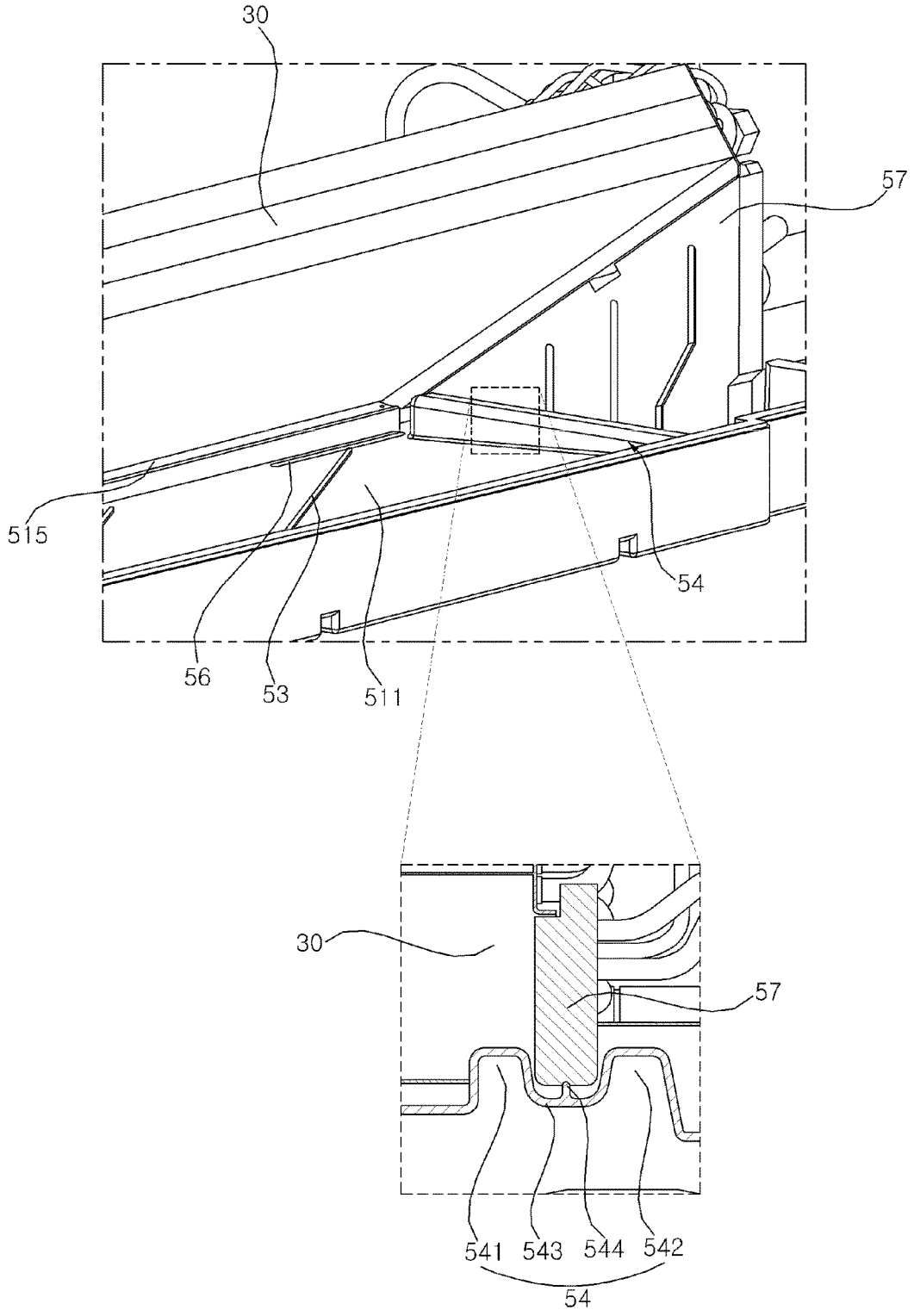
FIG. 20 is a diagram illustrating an enlarged view of a portion of a drain pan of an example of an indoor air conditioner.

FIG. 20 is a diagram illustrating an enlarged view of a portion of a drain pan of an example of an indoor air conditioner. For example, FIG. 20 illustrates an enlarged view of a portion of the first drain pan 50 on which the heat exchanger 30 can be seated or disposed.

The heat exchanger 30 can be supported on the seating surface 515. The heat exchanger 30 can be seated or disposed on an upper side of the first drain pan 50 at an angle. For example, the heat exchanger 30 can be disposed on an upper side of the first drain pan 50 at an oblique angle.

The guide passage 56 can be disposed or defined on the lower side of the heat exchanger 30. The one or more guide ribs 53 can be disposed on the lower side of the heat exchanger 30.

The first drain pan 50 can include a packing portion 57. The packing portion 57 can be disposed in the packing supporter 54. The packing portion 57 can be disposed between the packing supporter 54 and the heat exchanger 30. The packing portion 57 can support the heat exchanger 30.

One end of the packing portion 57 can be inserted between the first supporter wall 541 and the second supporter wall 542. One end of the packing portion 57 can be seated on an upper side of the one or more supporting ribs 544.

Figure 21:
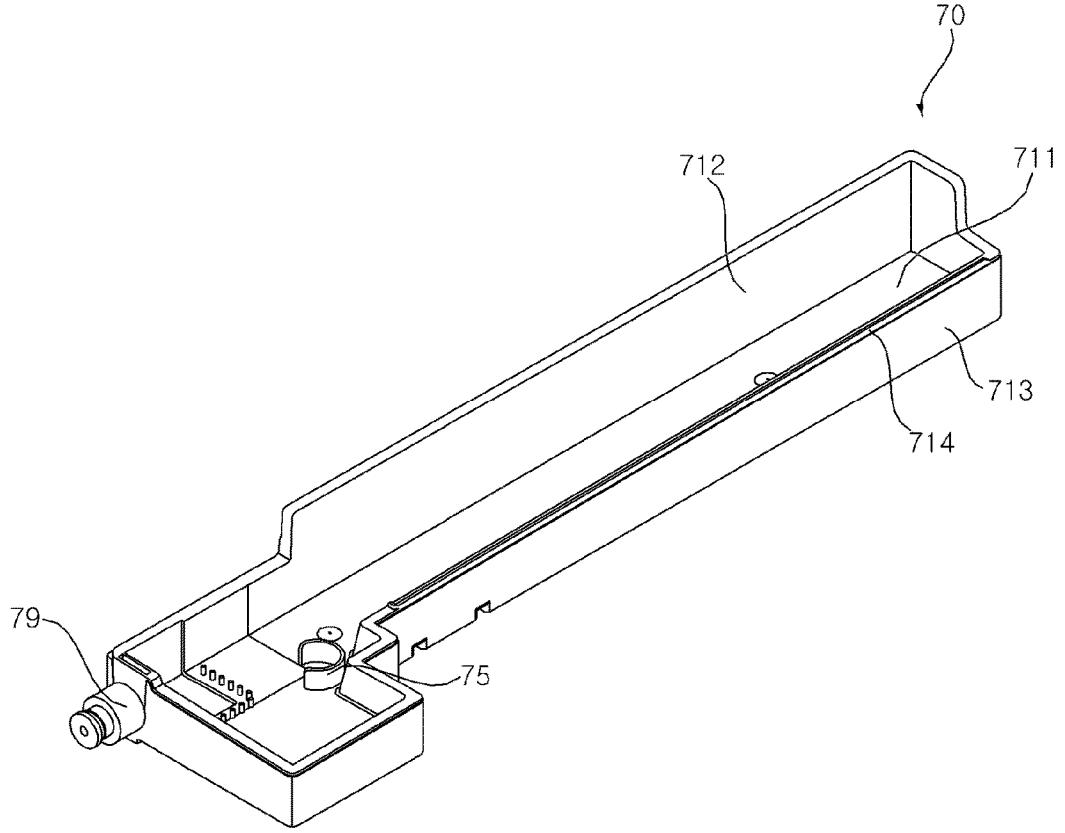
FIG. 21 is a diagram illustrating a perspective view of a drain pan of an example of an indoor air conditioner.

FIG. 21 is a diagram illustrating a perspective view of a drain pan of an example of an indoor air conditioner. For example, FIG. 21 illustrates the second drain pan 70.

Figure 22:
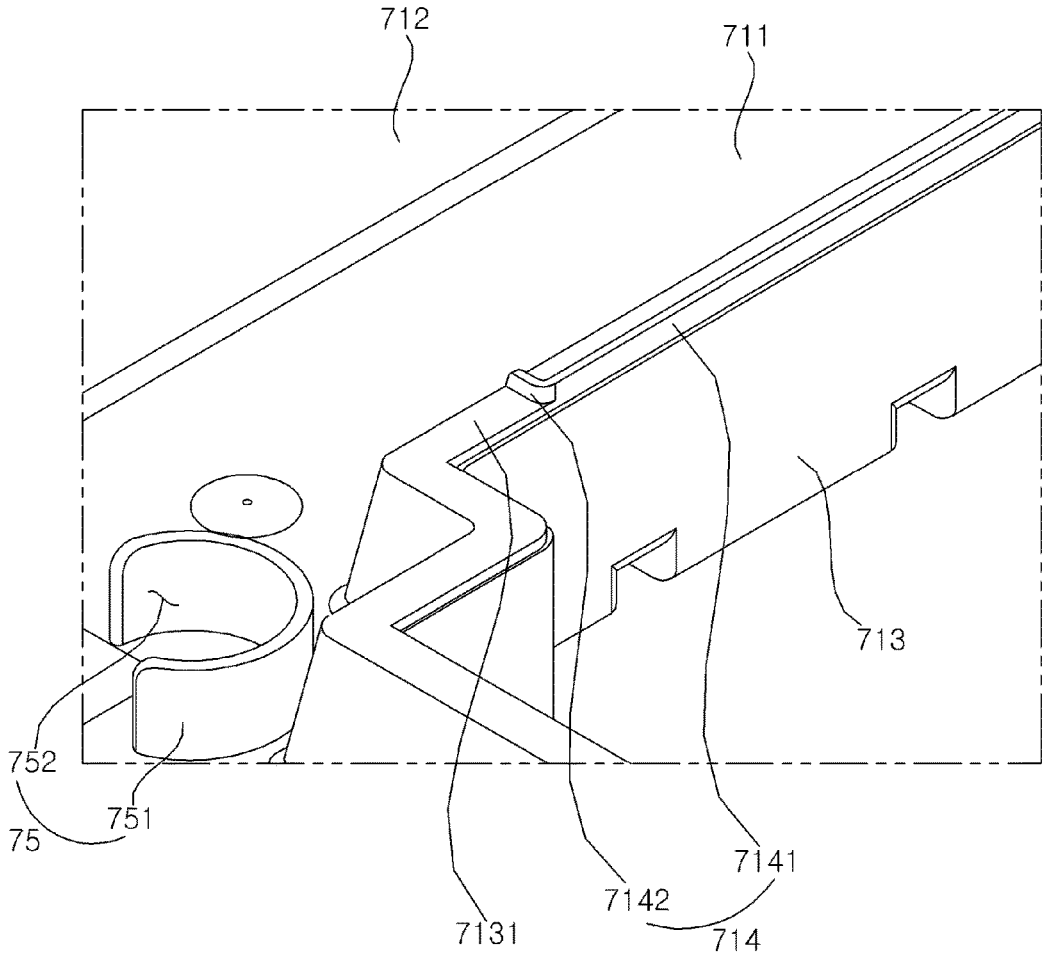
FIG. 22 is a diagram illustrating an enlarged view of a portion of a drain pan of an example of an indoor air conditioner.

FIG. 22 is a diagram illustrating an enlarged view of a portion of a drain pan of an example of an indoor air conditioner. For example, FIG. 22 illustrates a portion of the second drain pan 70.

The second drain pan 70 can include a second plate 711, a first wall 712, and a second wall 713. Condensed water generated in the heat exchanger 30 can flow toward the second water discharge port 79 between the first wall 712 and the second wall 713.

The second drain pan 70 can include a fence 714. The fence 714 can protrude upward from the second wall 713. The fence 714 can extend in the longitudinal direction of the second wall 713. The fence 714 can prevent condensed water from flowing out of the second drain pan 70.

The protruding body 75 can be disposed to face the second water discharge port 79. Condensed water flowing along the second plate 711 can flow to the second water discharge port 79 along the surface of the protruding body 75.

The protruding body 75 can include a body outer wall 751. The body outer wall 751 can have a cylindrical shape having an opening.

The protruding body 75 can include or define an opening 752. The opening 752 can be arc-shaped.

The fence 714 can include or define a fence wall 7141. The fence wall 7141 can extend along an extension direction of the second wall 713.

The fence 714 can include or define a fence edge 7142. The fence edge 7142 can extend in a direction that intersects with the fence wall 7141.

The fence 714 can protrude upward from an upper end 7131 of the second wall 713.

According to at least one of the implementations of the present disclosure, condensed water can be easily collected regardless of different arrangement types of the indoor air conditioner, by providing the first drain pan and the second drain pan.

According to at least one of the implementations of the present disclosure, the drain pan can be assembled based on different arrangement types of the indoor air conditioner, by disposing the first drain pan and the second drain pan separately.

According to at least one of the implementations of the present disclosure, the drain pan can be easily assembled, by disposing a guide at the installation position of the first drain pan and the second drain pan.

According to at least one of the implementations of the present disclosure, adaptability according to different arrangement types of the indoor air conditioner can be achieved based on interchangeability between the drain pan and the air guide.

Although the present disclosure has been described with reference to specific implementations shown in the drawings, it is apparent to those skilled in the art that the present description is not limited to those example implementations and is embodied in many forms without departing from the scope of the present disclosure, which is described in the following claims. These modifications should not be individually understood from the technical spirit or scope of the present disclosure.

What is claimed is:

1. An air conditioner comprising:

a case configured to be fixed in a first position or a second position that is different from the first position;

a fan disposed inside the case; and a heat exchanger that is (i) spaced apart from the fan in a first direction based on the case being fixed in the first position or (ii) spaced apart from the fan in a second direction based on the case being fixed in the second position, wherein the second direction intersects with the first direction, wherein, based on the case being fixed in the second position, a first drain pan is disposed at a lateral side end of the heat exchanger, and wherein, based on the case being fixed in the second position, a second drain pan that is detachably coupled to the case is disposed below the heat exchanger, wherein the first drain pan comprises:

a first plate that faces the heat exchanger and defines a recess on the first plate, and wherein the second drain pan comprises:

a second plate that faces the heat exchanger, and a first wall that extends from the second plate toward the first drain pan and is coupled to the recess.

2. The air conditioner of claim 1, wherein, based on the case being fixed in the first position, the first drain pan is disposed below the heat exchanger, and wherein, based on the case being fixed in the first position, the second drain pan is separated from the case.

3. The air conditioner of claim 1, wherein the first position corresponds to a position on a ceiling of an indoor space, and the second position corresponds to a position on a wall surface of the indoor space.

4. The air conditioner of claim 1, wherein the first direction corresponds to a horizontal direction relative to a ground, and the second direction corresponds to a vertical direction relative to the ground.

5. The air conditioner of claim 1, further comprising:

a partition wall disposed between the heat exchanger and the fan, wherein an assembly space is defined between the partition wall and the first drain pan, and wherein the second drain pan is disposed at the assembly space.

6. The air conditioner of claim 1, wherein the first drain pan and the second drain pan are detachably coupled to each other.

7. The air conditioner of claim 1, wherein the case comprises:

a first side plate that faces the second drain pan; and a support plate that is elevated or recessed relative to the first side plate, wherein the support plate and first side plate form a tiered arrangement, wherein the support plate defines a drain pan seating portion at a boundary between the support plate and the first side plate.

8. The air conditioner of claim 1, wherein the case comprises:

a second side plate that faces the second drain pan and defines an insertion groove; and a stopper spaced apart from the insertion groove, wherein the second drain pan comprises a fixing protrusion portion that is engaged with the insertion groove.

9. The air conditioner of claim 1, wherein the first drain pan comprises a seating body, and wherein the heat exchanger is disposed at the seating body.

10. The air conditioner of claim 1, wherein the first drain pan comprises a plurality of ribs that are disposed between the heat exchanger and the second drain pan and spaced apart from each other along a longitudinal direction of the heat exchanger.

11. The air conditioner of claim 1, wherein the heat exchanger is disposed at an oblique angle relative to an upper side surface of the second drain pan, and wherein the second drain pan comprises a second wall that is (i) spaced apart from and disposed below the heat exchanger and (ii) inclined in a direction parallel to the heat exchanger.

12. The air conditioner of claim 1, wherein the second drain pan comprises:

a second plate that is spaced apart from and disposed below the heat exchanger;

a second water discharge port that protrudes outward from an outer surface of the second plate; and a protruding body that protrudes from the second plate and faces the second water discharge port.

13. The air conditioner of claim 1, wherein the second drain pan comprises:

a second plate spaced apart from and disposed below the heat exchanger;

a second wall that extends from the second plate toward the heat exchanger; and a fence that protrudes upward from the second wall.

14. The air conditioner of claim 1, wherein the first drain pan comprises:

a packing portion configured to receive the heat exchanger; and a packing supporter disposed below the packing portion.

15. The air conditioner of claim 1, wherein the first drain pan comprises:

a packing portion configured to receive the heat exchanger;

a first plate spaced apart from and disposed below the heat exchanger;

a first supporter wall that protrudes upward from the first plate;

a second supporter wall that protrudes upward from the first plate and is spaced apart from the first supporter wall; and a supporting rib that is disposed between the first supporter wall and the second supporter wall and receives the packing portion.

16. The air conditioner of claim 1, wherein the first drain pan comprises:

a first upper body that faces the heat exchanger;

a first lower body that is coupled to the first upper body and made of an insulating material; and a trench defined between the first upper body and the first lower body.

17. An air conditioner comprising:

a case configured to be fixed in a first position or a second position that is different from the first position;

a fan disposed inside the case;

a heat exchanger that is (i) spaced apart from the fan in a first direction based on the case being fixed in the first position or (ii) spaced apart from the fan in a second direction based on the case being fixed in the second position, wherein the second direction intersects with the first direction; and an air guide detachably coupled to the case based on the case being fixed in the first position, wherein, based on the case being fixed in the second position, a first drain pan is disposed at a lateral side end of the heat exchanger, and wherein, based on the case being fixed in the second position, a second drain pan that is detachably coupled to the case is disposed below the heat exchanger.

18. The air conditioner of claim 17, wherein, based on the case being fixed in the second position, the air guide is configured to be interchangeably used with the second drain pan.

19. The air conditioner of claim 17, wherein the air guide is disposed between the fan and the heat exchanger.

* * * * *